US007140507B2

(12) United States Patent
Maldonado et al.

(10) Patent No.: US 7,140,507 B2
(45) Date of Patent: Nov. 28, 2006

(54) INSULATED ICE CHEST WITH ACCESSORY HOLDERS

(75) Inventors: John Maldonado, Katy, TX (US); Minh Leba, Houston, TX (US); Fred Schmidt, Katy, TX (US)

(73) Assignee: Igloo Products Corporation, Houston, TX (US)

( * ) Notice: Subject to any disclaimer, the term of this patent is extended or adjusted under 35 U.S.C. 154(b) by 0 days.

(21) Appl. No.: 10/852,662

(22) Filed: May 25, 2004

(65) Prior Publication Data

US 2005/0263527 A1 Dec. 1, 2005

(51) Int. Cl.
*A47J 41/00* (2006.01)
*B65D 81/38* (2006.01)

(52) U.S. Cl. ..... 220/592.2; 220/23.83; 220/915.2; 62/457.7

(58) Field of Classification Search ..... 220/23.83, 220/592.2, 592.25, 915.1, 915.2, 23.2, 23.4, 220/737; 62/371, 372, 457.1, 457.2, 457.7; D15/83; 221/302
See application file for complete search history.

(56) References Cited

U.S. PATENT DOCUMENTS

| | | | | |
|---|---|---|---|---|
| 4,213,310 | A | 7/1980 | Buss | 62/457 |
| 4,407,089 | A * | 10/1983 | Miller | 43/21.2 |
| 4,916,923 | A | 4/1990 | Adams | |
| 5,105,958 | A * | 4/1992 | Patton | 215/388 |
| 5,419,154 | A * | 5/1995 | Christoff | 62/457.3 |
| 5,471,779 | A | 12/1995 | Downey | |
| 6,076,298 | A | 6/2000 | Teel | |
| 6,113,129 | A | 9/2000 | Marques et al. | |
| 6,131,925 | A | 10/2000 | Weldon | |
| 6,185,860 | B1 | 2/2001 | Thibodeaux | |
| 6,216,488 | B1 | 4/2001 | Rucker | |
| 6,296,165 | B1 | 10/2001 | Mears | 224/610 |
| 6,328,165 | B1 * | 12/2001 | Baker et al. | 209/235 |
| 6,328,179 | B1 * | 12/2001 | Conrado et al. | 220/592.2 |
| D456,974 | S | 5/2002 | Hicks | |
| 6,467,779 | B1 | 10/2002 | Mills | |
| 6,474,097 | B1 | 11/2002 | Treppedi et al. | |
| 6,554,012 | B1 | 4/2003 | Patarra | |
| D478,649 | S * | 8/2003 | Steudeman et al. | D22/147 |
| 6,637,233 | B1 | 10/2003 | Flum | 62/371 |
| D483,436 | S * | 12/2003 | Tull | D22/147 |

OTHER PUBLICATIONS

Igloo Products Catalog; "Igloo Cup Dispenser"; p. 50; no date.
Igloo Commercial Products; "Cooler Parts"; http://www.igloocommercial.com; no date.

(Continued)

*Primary Examiner*—Nathan J. Newhouse
*Assistant Examiner*—Harry Grosso
(74) *Attorney, Agent, or Firm*—Howrey LLP

(57) ABSTRACT

An improved insulated cooler has accessory holders detachably secured to its outer wall. An exemplary holder is provided for containerized drinks. The holder is made of a rigid plastic upper ring at the top and may have flexible fabric or mesh lower portion at the bottom such that the holders can be nested into receptacles in the top surface of the lid for convenient storage. This arrangement provides the benefit of permitting the user to access conveniently the contents of the ice chest without having to remove drinks that otherwise would be sitting on the lid of the ice chest. There also may be one or more connections on the ice chest that permit a fishing rod holder, an umbrella holder, or other accessory holder to be affixed to the cooler.

17 Claims, 5 Drawing Sheets

OTHER PUBLICATIONS

Igloo Commercial Products; "Cup Dispenser Lids"; http://www.igloocommercial.com; no date.
Igloo Commercial Products; "Cup Dispenser Brackets"; http://www.igloocommercial.com; no date.
Aubuchon Hardware; "Igloo-Industrial Cooler With Cup Dispenser"; http://www.aubuchonhardware.com; no date.
Aubuchon Hardware; "Igloo-Water Cooler Cup Dispenser"; http://www.aubuchonhardware.com; no date.
Aubuchon Hardware; "Industrial Cooler with Cup Dispenser"; http://www.aubuchonhardware.com; no date.
ProTools Direct.com; Igloo Product-4-4.5oz. Plastic Cup Dispenser W/Bracket; http://www.protoolsdirect.com; no date.
Igloo Products Corp. 2004 Catalog; 7 pages; 2003.
Zatuchni; "The Beach Box" 1 page—1999.
"Igloo Times—Updating a Timeless Concept", 2003 Product Catalog, © 2002 Igloo Products Corp.

* cited by examiner

INSULATED ICE CHEST WITH ACCESSORY HOLDERS

BACKGROUND AND SUMMARY OF THE INVENTION

The present invention relates to insulated ice chests or coolers and, more particularly, to an insulated ice chest having beverage and other accessory holders detachably secured thereto.

Insulated ice chests and coolers (hereinafter generically referred to as "coolers") are regularly used to transport food and beverages on recreational outings such as to the beach, to sporting events and on picnics. Insulated coolers are used not only to transport food and beverages to remote locations, but also to maintain the food and beverages at a reduced temperature, often with the aid of ice cubes or ice packs.

In many environments it is advantageous to provide receptacles in the cooler structure so that as the beverages are consumed over time, they need not be placed on the ground where they are more likely to be knocked over or become soiled. Thus, many insulated coolers have been provided with beverage receptacles. Typically, the beverage receptacles are included in the cooler lid or as permanent receptacles on a side or front face of the cooler. A problem with the providing beverage receptacles in the lid, however, is that the beverages must be removed each time the interior of the cooler is accessed. A disadvantage of incorporating beverage receptacles on a front or side wall of the cooler is that such receptacles may not always be required, but add to the dimensions of the unit whether or not they are used.

There are other articles which may from time to time be used by the consumer in conjunction with a cooler. For example, coolers are often taken along when fishing. Therefore, it would be advantageous to associate a fishing rod receptacle with the cooler to hold the fishing rod while the fisherman waits for the fish to bite, or takes a break for a snack. Insulated coolers are also taken to the beach where the customer may wish to use a beach umbrella. It is often desirable to brace the beach umbrella against the side of the cooler and, therefore, an umbrella holder accessory would be another advantageous accessory for association with an insulated cooler.

The present invention provides beverage and other accessory holders which may be selectively detachably secured to an outer wall of an insulated cooler. Because the accessory holders may be removed and stored, they do not contribute to the cooler dimensions during periods of non-use. Detachably secured holders also allow the consumer to selectively add or remove accessory holders on a portion of the cooler where it is convenient and in a number and at a location suitable to the customer's immediate needs.

As will be appreciated, a variety of accessory holders may be provided in accordance with the invention and selectively detachably secured to the insulated cooler. By way of example, an accessory holding ring, which may be used for example to hold beverage bottles, cans, or cups, is provided. Also provided as an exemplary embodiment is an elongated accessory holder which may be used, for example, to receive a fishing rod.

Thus, the invention may be embodied in an insulated cooler comprising upstanding insulating front, rear and side walls, a bottom wall and a lid, the walls and lid together defining an insulated enclosed space; at least one accessory holder having a first coupling portion; at least one second coupling portion complimentary to said first coupling portion provided on one of said front, rear and side walls for selectively coupling said accessory holder to said respective wall; wherein said accessory holder comprises a frame defining a perimeter of an accessory receiving space having an upwardly open mouth and wherein said first coupling portion is provided on an outer periphery of said frame.

BRIEF DESCRIPTION OF THE DRAWINGS

These and other objects and advantages of this invention will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
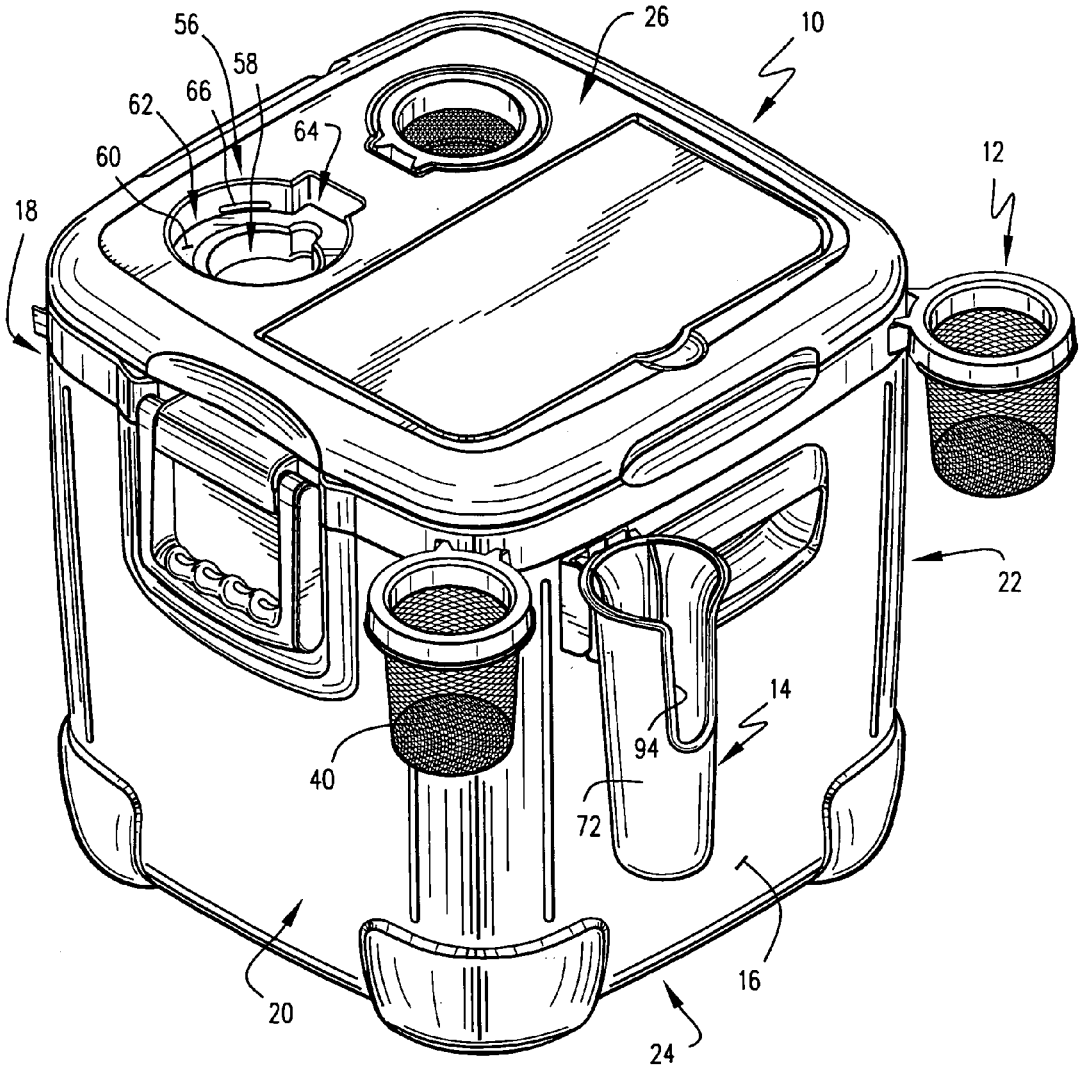
FIG. 1 is a perspective view of an insulated cooler having accessory holders coupled thereto in accordance with an exemplary embodiment of the invention.

As will be appreciated from the description provided hereinbelow, a variety of accessory holders may be provided in accordance with the invention. FIG. 1 illustrates by way of example an insulated cooler 10 having various accessory holders 12,14 detachably secured thereto to illustrate exemplary embodiments of the invention.

The insulated cooler 10 is comprised of upstanding insulating front 16, rear 18, and side 20, 22 walls; a bottom wall 24; and a lid 26. The walls and lid together define an insulated enclosed space. Each accessory holder 12, 14 has a first coupling portion 28, 30. Second coupling portions 32, 34 complimentary to the first coupling portions 28, 30 are provided on the front 16, rear 18, and/or side 20, 22 wall(s) for selectively coupling the accessory holder 12, 14 to the cooler.

In the illustrated embodiment, accessory holder 12 is comprised of a truncated holder frame 36 defining a perimeter of an accessory receiving space 38 having an upwardly open mouth. As shown, the first coupling portion 28 is provided on an outer periphery of the frame 36. The holder frame 36 preferably defines a closed perimeter to fully encircle the accessory receiving space 38. However, the holder frame may be generally c-shaped, that is circumscribing more than one half and preferably about ¾ of the accessory receiving space 38, if deemed necessary or desirable to accommodate the accessory, as described in greater detail hereinbelow. The holder frame 36 is illustrated as being generally circular in cross-section since in an exemplary embodiment it is used to receive a beverage container, which is typically also circular in cross-section. It is to be understood, however, that a holder frame provided in another, e.g., straight-sided shape, such as a square or hexagon could be used without departing from the invention.

In the embodiment illustrated in FIG. 1, the holder frame 36 is used to receive a beverage container such as a bottle, can or glass (not shown). To support the beverage container from below, a bag like receptacle 40 is provided to extend downwardly from the holder frame 36 so that the holder is well suited to beverage containers of any of the variety of sizes and shapes. Such a receptacle 40 may be omitted, however, where the holder frame's shape and size generally correspond to that of the beverage container and the beverage container has a flared or enlarged top end or has a tapered outer wall that is larger adjacent its upper portion, to engage and be held by the frame on insertion.

As mentioned above, the holder frame 36 is secured to the outer wall of the cooler 10 by providing complimentary coupling portions 28, 32 on the frame and on the cooler outer wall. In the illustrated embodiment, the coupling portion 32 provided on the cooler outer wall defines a generally dovetail shaped receptacle having first and second inclined walls 42, 44 and a bottom wall 46 to limit the displacement of the holder with respect to the receptacle. The holder frame 36 likewise includes a pair of outwardly flared walls 48, 50 for laterally locking the holder frame 36 with respect to the coupling portion 32. Stop walls 52, 54 are defined adjacent the upper end of the flared walls 48, 50 to limit downward displacement of the frame 36 with respect to the coupling portion 32 provided on the cooler. Thus, when the holder is attached to the cooler, the inclined/flared walls 42, 44, 48, 50 limits or precludes lateral displacement of the holder away from the cooler and the stop walls 52, 54 and bottom wall 46 respectively limit the downward displacement of the holder. However, the holder can be readily removed from the cooler by lifting as shown by the exploded view of FIGS. 2 and 3.

Although radially projecting legs to define a dovetail like projection 28 and a dovetail like receptacle 32 are respectively provided to secure holder 12 and cooler 10 in the illustrated embodiment, it is to be understood that other complimentary coupling structures, such as a solid dove-tail projection or a T-shaped projection and corresponding slot or groove, may be provided without departing from the invention. Moreover, it is to be appreciated that the inverse of the connector arrangement shown could be provided so that the protrusion is defined on the cooler and the receptacle on the holder.

When the holder frame is not in use, advantageously it may be seated in the lid 26 of the cooler 10 in a respective receptacle 56 as illustrated in FIG. 1. Advantageously, when provided, the container receptacle 40 can be collapsed into a lower part 58 of the two-tiered holder receptacle 56. The frame 36 of the holder 36 is then seated on the ledge 60 defined by the larger portion 62 of the two-tiered receptacle 56. A cutout 64 is provided to accommodate the flared walls 48, 50 of the holder. It is further seen in FIG. 1 that a at least one locking projection 66 is defined on an inner wall of the larger portion 62 of receptacle 56. Furthermore, at least one projecting lip 68 is provided on the holder frame 36. In the illustrated embodiment, primarily for aesthetic reasons, the projecting lip 68 of the holder 36 extends substantially about the entire periphery. However, spaced projecting lip segments may be provided at spaced locations about the holder frame. Thus, when the holder frame is not in use, it may be snap-locked into position in the larger portion 62 of the two-tiered receptacle 56, with the receptacle portion 40 of the holder 12 seated, e.g., collapsed, in the lower part 58. When it is desired to remove the holder frame from its respective receptacle, the consumer can reach under the holder frame 36 into the finger accommodating space 70 defined in the lower part 58 of receptacle 56 and snap the holder 36 out of its storage position. Because the container receptacle or bag 40 (if provided) is flexible, it does not serve as an impediment to the unlocking motion described above.

While in the illustrated embodiment a bag-like container receptacle 40 is provided to receive the bottom portion of the beverage container, it is to be understood that a rigid, partially rigid, and/or telescopically collapsible container receptacle can be provided integral with or attached to the frame 36 in lieu of a flexible bag or net.

Figure 2:
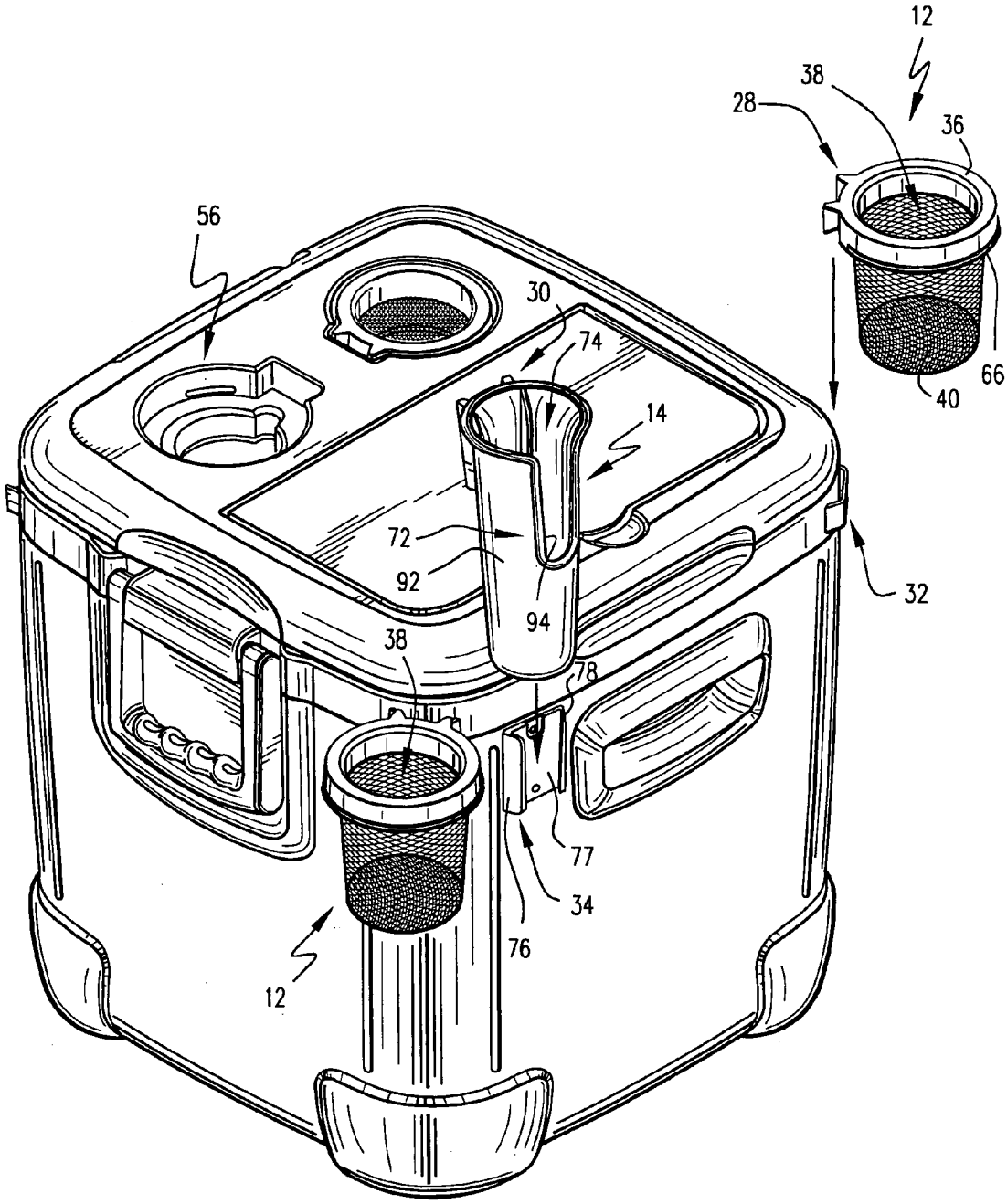
FIG. 2 is a view similar to FIG. 1 with a fishing rod and cup holder exploded away from the cooler to illustrated the respective coupling portions.
Figure 3:
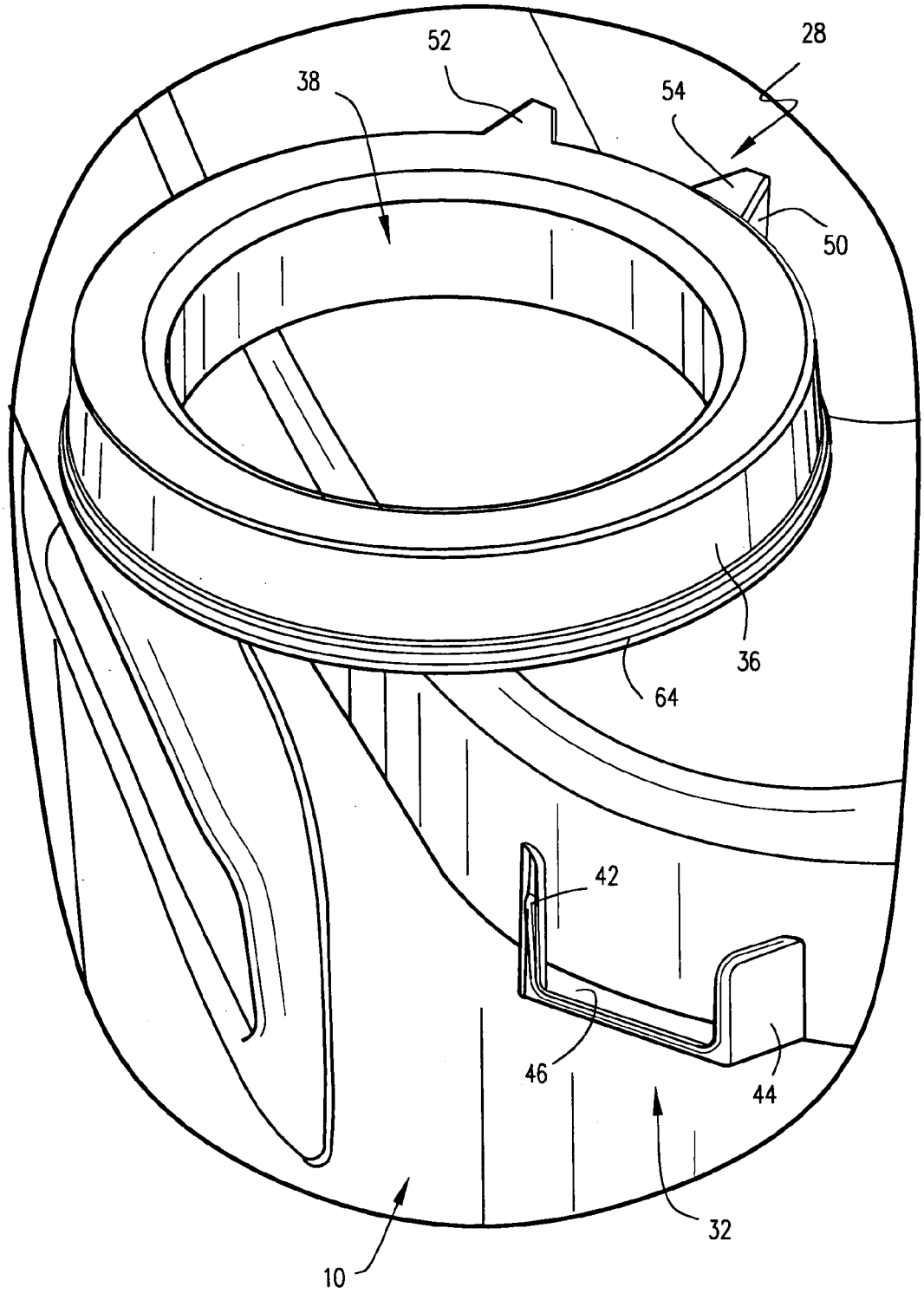
FIG. 3 is an enlarged perspective view showing an exemplary accessory holder and coupling assembly.
Figure 4:
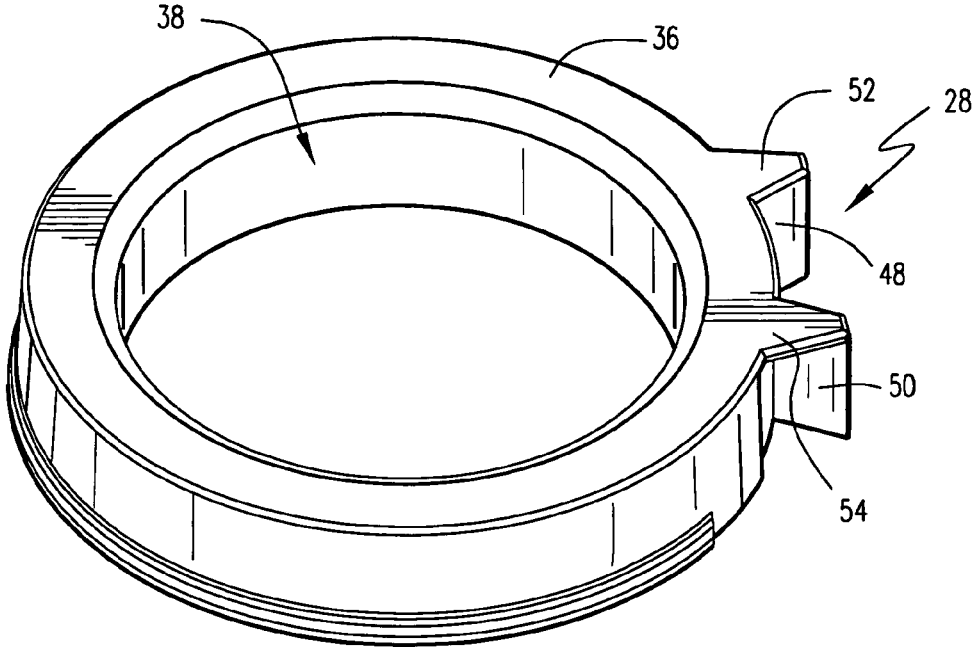
FIG. 4 is a perspective view of an accessory holder embodying the invention, taken from above.
Figure 5:
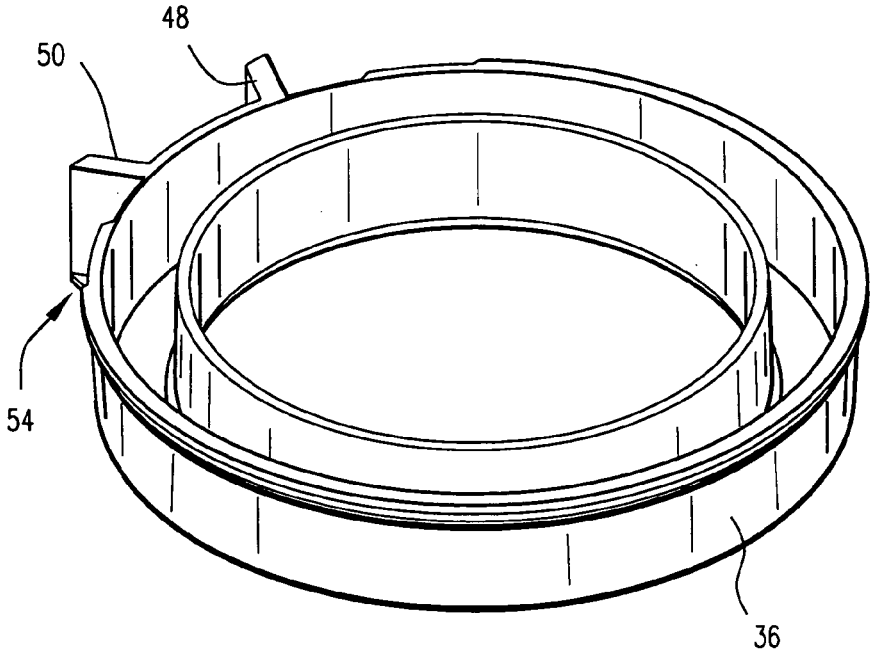
FIG. 5 is a perspective view of an accessory holder embodying the invention, taken from below.
Figure 6:
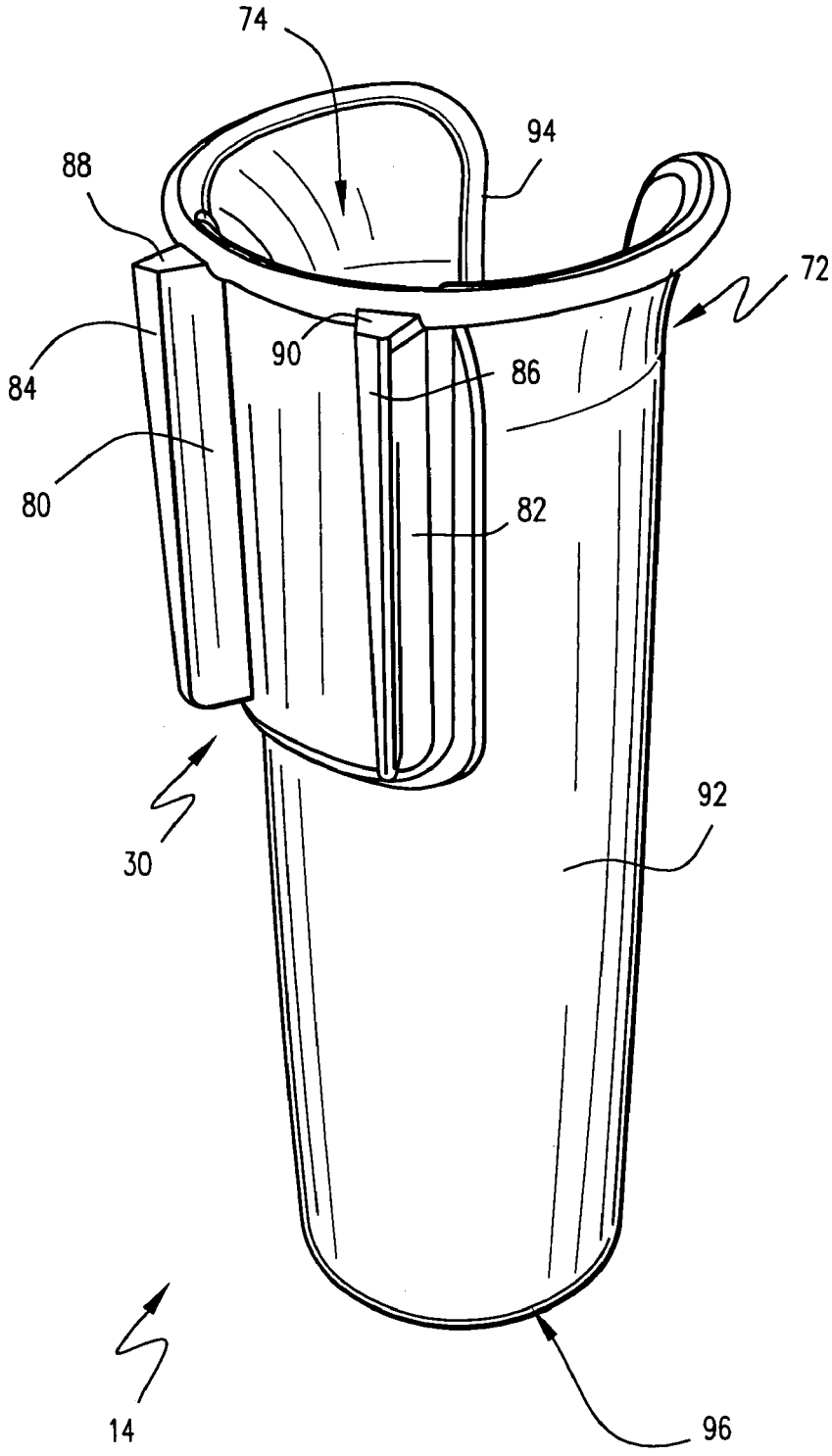
FIG. 6 is a perspective view of a fishing rod holder, from behind, in accordance with an embodiment of the invention.

Reference will now be made to the elongated frame 72 defining the accessory holder 14, illustrated in particular in FIGS. 1, 2, and 6, which may be used to receive and hold, e.g., a fishing rod handle. The frame 72 defines an accessory receiving area 74 having and an upwardly open mouth. This holder includes first connector portion 30 for engaging complimentary second connector portion 34 provided on an outer wall of the insulated cooler 10. Because holder 14 is vertically elongated, the first and second connector portions are similarly elongated to support the holder body securely with respect to the cooler.

In the illustrated embodiment, the first and second connector portions 30, 34 are respectively defined by a generally dovetail projection or protrusion and a corresponding generally dovetail receptacle. The dovetail protrusion 30 in this embodiment is provided on the outer wall of the frame or housing 72 of the elongated holder 14 and the dovetail receptacle 34 is defined on the cooler wall. It is to be appreciated that the protrusion may be provided on the cooler and the receptacle on the holder, albeit inverted to support the holder. The coupling receptacle may be the same or similar to the complimentary couplings provided for cup dispensers provided, e.g., on conventional 5 and 10 gallon plastic beverage coolers manufactured by Igloo Products Corporation. Thus, the second coupling portion 34 includes first and second walls 76, 78, joined by base 77. Walls 76, 78 are inclined towards one another to define the generally dovetail receptacle. Coupling walls 80, 82 project from the elongated holder frame or housing 72. In the illustrated embodiment, the legs project generally radially and receptacle engaging walls 84, 86 having inclined edges are provided for being slidably and lockingly disposed in the dovetail receptacle. Upper walls 88, 90 are also provided for limiting the displacement the elongated holder 14 with respect to the second coupling portion 34. It is to be understood that rather than providing wedge walls 84, 86, the radial walls 80, 82 may be flared outwardly to engage the inclined walls of the receptacle. In the illustrated embodiment, the elongated frame or housing 72 includes a generally cylindrical side wall 92 and a slot 94 for accommodating the reel mounted to the fishing rod. Thus it may be said that the frame or housing 72 is substantially circular in cross-section. It is to be understood, however, that the frame may have, e.g., a straight-sided shape, such as a square or hexagon, without departing from the invention. Moreover, as illustrated, the generally cylindrical side wall 92 and the receptacle defined thereby can be flared towards the upper open end thereof, so that the fishing rod holder is narrowest adjacent its closed bottom wall 96.

While the bottom of the holder 14 may be open, it is preferred that a bottom wall 96 be provided on which, e.g., the fishing rod handle can rest so that the weight of the fishing rod is not borne by the reel attachment structure engaging the slot 94. Although the holder 14 has been characterized as particularly suitable for a fishing rod, it is to be understood that an elongated holder may be provided to accommodate other accessories such as a flashlight, utensils, or other elongated tool(s) or device(s).

As mentioned above, coolers are often transported onto the beach and braced against a beach umbrella to not only be shaded, but also to help hold the umbrella shaft in position. In accordance with a further advantageous characteristic of the invention, an accessory holder embodying the invention such as a holder frame 36 having no container receptacle 40 can be used to engage a beach umbrella shaft. For example, such a holder frame 36 can be slipped over the insertion end of the umbrella shaft before the umbrella is planted into the ground. Then, after the umbrella shaft is planted, the holder frame can be displaced along the shaft to align with the complementary coupling portion 32 provided on the ice chest, thereby defining a support ring to aid in the support of the umbrella. In the alternative, a holder frame embodying the invention defined as a part circumferential or c-shaped holder may be provided that can be engaged with the umbrella after planting and then coupled to the ice chest.

By way of example, holder frames which may be used as a beverage holder, a fishing rod holder, and/or and umbrella holder have been illustrated and described as detachably secured to an insulated cooler. However, those skilled in the art will appreciate from the disclosure provided that these are merely examples of a variety of holders which may be detachably secured to an insulated cooler using the principles of the invention. Likewise, the holders described may be used to receive and hold a variety of devices, components, and accessories, not just beverage containers, fishing rods, and umbrellas. Therefore, the specification is not to be limited to the particular holder types and accessories described herein. Indeed, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An insulated cooler comprising:

upstanding insulating front, rear and side walls, a bottom wall and a lid, the walls and lid together defining an insulated enclosed space;

at least one accessory holder having a first coupling portion;

at least one second coupling portion complimentary to said first coupling portion provided on one of said front, rear and side walls for selectively coupling said accessory bolder to said respective wall, wherein said accessory holder comprises a frame defining a perimeter of an accessory receiving space having an upwardly open mouth and wherein said first coupling portion is provided on an outer periphery of said frame;

at least one accessory holder storage receptacle defined in the lid of the cooler, wherein the storage receptacle is comprised of upper and lower portions, the upper portion having a diameter greater than the lower portion, the upper portion generally corresponding is size and shape to the frame of the accessory holder.

2. An insulated cooler as in claim 1, wherein said frame is substantially circular in cross-section.

3. An insulated cooler as in claim 1, further comprising a receptacle depending from said frame for receiving and supporting an accessory disposed in said accessory receiving space.

4. An insulated cooler as in claim 1, wherein, one of said first and second coupling portions defines a generally dovetail projection and the other of said coupling portions defines a generally dovetail receptacle for selectively receiving said dovetail projection.

5. An insulated cooler as in claim 4, wherein said dovetail receptacle is defined by a first and second inclined legs projecting from said one of said holder and said side wall and a bottom wall portion extending between said inclined walls for defining said dovetail receptacle.

6. An insulated cooler as in claim 4, wherein said dovetail projection comprises first and second flared walls extending outwardly from said one of said holder and said side wall, said flared walls projecting away from one another so the spacing between proximal ends of said flared walls is less than a spacing between distal ends of said flared walls.

7. An insulated cooler as in claim 6, wherein said dovetail projection further comprises wedge-shaped walls respectively extending generally perpendicular to said flared walls, said wedge-shaped wails having a maximum width adjacent an upper end thereof and a minimum width adjacent a lower end thereof.

8. An insulated cooler as in claim 1, wherein said accessory holder comprises a fishing rod holder, said fishing rod holder comprising an elongated generally cylindrical receptacle having a closed bottom wall and having a slot in a side wall thereof for accommodating a rod attachment portion of a fishing reel.

9. An insulated cooler as in claim 8, wherein said receptacle is flared toward said upwardly open mouth.

10. An insulated cooler as in claim 1, wherein the frame defines a closed perimeter.

11. An insulated cooler as in claim 10, wherein the holder is circular in cross-section.

12. An insulated cooler as in claim 1, wherein said first coupling portion is provided at or adjacent said upwardly open mouth of said accessory receiving space.

13. An insulated cooler as in claim 1, wherein said accessory holder has a substantially closed bottom wall to define an upwardly open receptacle.

14. An insulated cooler as in claim 1, wherein said holder comprises said frame and a flexible walled receptacle.

15. An insulated cooler as in claim 1, wherein said second coupling portion is provided adjacent an upper edge of said wail of the cooler.

16. An insulated cooler as in claim 1, further comprising at least one locking member for locking the holder frame in the upper portion of the receptacle.

17. An insulated cooler comprising:

upstanding insulating front, rear and side walls, a bottom wall and a lid, the walls and lid together defining an insulated enclosed space;

at least one accessory holder having a first coupling portion;

and at least one second coupling portion complimentary to said first coupling portion provided on one of said front, rear and side wails for selectively coupling said accessory holder to said respective wall;

wherein said accessory holder comprises a frame defining a perimeter of an accessory receiving space having an upwardly open mouth and wherein said first coupling portion is provided on an outer periphery of said frame;

wherein one of said first and second coupling portions defines a generally dovetail projection and the other of said coupling portions defines a generally dovetail receptacle for selectively receiving said dovetail projection;

wherein said dovetail projection comprises first an second flared walls extending outwardly from said one of said holder and said side wall, said flared walls projecting away from one another so the spacing between proximal ends of said flared walls is less than a spacing between distal ends of said flared walls; and wherein said dovetail projection further comprises wedge-shaped walls respectively extending generally perpendicular to said flared walls, said wedge-shaped walls having a maximum width adjacent an upper end thereof and a minimum width adjacent a lower end thereof.

* * * * *

UNITED STATES PATENT AND TRADEMARK OFFICE

CERTIFICATE OF CORRECTION

PATENT NO. : 7,140,507 B2
APPLICATION NO. : 10/852662
DATED : November 28, 2006
INVENTOR(S) : John Maldonado, Minh Leba and Fred Schmidt It is certified that error appears in the above-identified patent and that said Letters Patent is hereby corrected as shown below:

Col. 1 In claim 1, line 49, change “bolder” to read --holder--

Col. 1 In claim 1, line 58, change “is” to read --in--

Col. 6 In claim 7, line 18, change “wails” to read --walls--

Col. 6 In claim 15, line 43, change “wail” to read --wall--

Col. 6 In claim 17, line 55, change “wails” to read --walls--

Signed and Sealed this

First Day of May, 2007

JON W. DUDAS
*Director of the United States Patent and Trademark Office*